United States Patent [19]

Aula et al.

[11] Patent Number: 4,625,430

[45] Date of Patent: Dec. 2, 1986

[54] DRYING SECTION AND METHOD IN PAPER MACHINE

[75] Inventors: Jouko Aula; Raima Kerttula, both of Jyväskylä, Finland

[73] Assignee: Valmet Oy, Finland

[21] Appl. No.: 741,227

[22] Filed: Jun. 4, 1985

[30] Foreign Application Priority Data

Jun. 6, 1984 [FI] Finland ..... 842285
Jun. 8, 1984 [FI] Finland ..... 843094

[51] Int. Cl.[4] ..... F26B 3/24

[52] U.S. Cl. ..... 34/13; 34/41; 34/66; 34/116; 34/123

[58] Field of Search ..... 34/116, 123, 62, 66, 34/114, 111, 121, 119, 124, 13, 41

[56] References Cited

U.S. PATENT DOCUMENTS

| | | | |
|---|---|---|---|
| 1,144,896 | 6/1915 | Fosbraey | 34/62 |
| 2,151,049 | 3/1939 | Laing | 34/110 |
| 3,079,699 | 3/1963 | Fry, Jr. | 34/116 |
| 3,337,968 | 8/1967 | Krikorian et al. | 34/116 |
| 3,868,780 | 3/1975 | Soininen et al. | 34/116 |
| 4,202,113 | 5/1980 | Kankaanpaa | 34/116 |
| 4,253,246 | 3/1981 | Marchal | 34/121 |
| 4,516,330 | 5/1985 | Eskelinen et al. | 34/114 |

*Primary Examiner*—Larry I. Schwartz
*Attorney, Agent, or Firm*—Steinberg & Raskin

[57] ABSTRACT

A multi-cylinder drying section and method in a paper machine wherein the paper web to be dried is guided into contact with the surfaces of heated drying cylinders wherein the drying fabric is cooled as it travels from one drying cylinder to the next. According to one embodiment, preferably used in the first group or groups of drying cylinders, a single-fabric draw is used wherein the web is supported on the drying fabric as it runs from the cylinders of one line to the cylinders of the other line so that the web is in direct contact with the surfaces of the drying cylinders in one line while the drying fabric is in direct contact with the surfaces of the cylinders in the other line. The drying fabric is cooled as it runs between the cylinders on which the web is in direct contact with the heated surfaces by causing the drying fabric to come into direct contact with a cooling roll or cylinder surface whose contact area is relatively large. In another embodiment wherein the web is conducted through the drying section in a twin-wire draw, i.e., wherein the web travels between the cylinders of the respective lines in an open draw, the drying fabrics come into direct contact with guide rolls which act as cooling members to cool the respective fabrics. The invention provides lower production costs and reduced energy consumption as well as improved machine reliability, a significantly reduced length of the drying section and increased service life of the drying fabrics.

44 Claims, 5 Drawing Figures

DRYING SECTION AND METHOD IN PAPER MACHINE

BACKGROUND OF THE INVENTION

The invention relates generally to paper making and, more particularly, to drying sections and methods in paper making machines.

The invention is applicable both in drying sections of the single-fabric draw type, wherein the drying fabric runs from a drying cylinder of one line to a drying cylinder of another line supporting the web in the spaces between the lines, as well as in the drying sections of the twin-wire draw type wherein the web comes into direct contact with the surfaces of the drying cylinders by means of outer drying wires and/or felts which are guided by guide rolls in the spaces between the successive drying cylinders.

In particular, a first embodiment of the invention is utilized in an arrangement, preferably in the initial drying group or groups, wherein the paper web to be dried is guided in direct contact against the surfaces of heated drying cylinders as a single-fabric draw wherein the drying fabric, which is preferably a relatively open drying wire, runs in a serpentine path from one line of drying cylinders or rolls to the other, so that the web is supported by the drying fabric in the spaces between the lines of drying cylinders. The web is placed in direct contact with the heated surface of the drying cylinders in one of the lines, while the drying wire comes into direct contact with the surface of the rolls or cylinders in the other line with the web being situated outside of the drying fabric. In this embodiment, the drying section comprises one or more successive drying groups, each consisting of two lines of cylinders and/or rolls, at least the initial drying group or groups being provided with a single-fabric draw so that the paper web is supported on the drying fabric over its entire passage through the drying group.

The drying fabric presses the web to be dried into direct contact against the surface of the drying cylinders in one of the lines while the drying fabric is in direct contact with the surface of the cylinders or rolls of the other line with the web being situated outside of the drying fabric.

A second embodiment of the invention is utilized in an arrangement wherein the web to be dried is guided into direct contact with the surfaces of heated drying cylinders and pressed against the heated cylinder surfaces by an outer drying wire and/or felt which is guided by guide rolls situated in the spaces between the successive drying cylinders. The drying section comprises one or more successive drying groups, each including two lines of drying cylinders situated one above the other, preferably in horizontal rows. In connection with the upper cylinder line, there is an upper drying wire or felt which is guided by guide rolls which are situated in the spaces between the drying cylinders. In connection with the lower cylinder line there is a second drying wire or felt which is guided by guide rolls which are situated in the spaces between the cylinders of the lower line.

Multi-cylinder drying sections of paper machines conventionally include two horizontal lines of drying cylinders, one located above the other, wherein the paper web runs in a serpentine manner between the drying cylinders of the respective lines.

A web to be dried is conventionally passed through such drying sections in either a single-wire or twin-wire draw. In a single-wire draw, the web runs from one drying cylinder in one line to the next drying cylinder in the other line, supported by the same drying wire. In twin-wire arrangements wherein upper and lower wires are used to press the web against the surfaces of the drying cylinders, the web runs from the drying cylinders of one line to the drying cylinders of the other line in an unsupported free draw. The present invention relates to drying sections and methods in which single-wire and/or twin-wire draws are used.

In drying sections of the type described above, the web is dried by coming into contact with the hot surface of a drying cylinder or cylinders. The efficiency of such contact drying depends on the nature of the contact between the web and the hot surface of the drying cylinder and it is the primary function of the drying wire or fabric to improve such contact. Another important factor contributing to the efficiency of contact drying is the temperature of the drying wire which has an important effect on the rate of drying.

Drying wires generally have a relatively open construction in order to facilitate ventilation of the space or pocket formed by the web, drying wire and the drying cylinder. It has been understood that in view of the open nature of drying wires, water vapor will pass in an uncondensed state through the wire.

A single-fabric drying section is disclosed in U.S. Pat. No. 3,503,139 assigned to Beloit Corporation. The drying section comprises two horizontal lines of steam-heated drying cylinders in which one line is situated within the wire or felt loop which therefore comes into direct contact with the cylinders while the drying cylinders of the other line are situated outside of the wire or felt loop. The drying section disclosed in this patent utilizes the customary technique of raising the temperature of the drying cylinders situated within the loop to a higher temperature than the cylinders situated outside of the wire or felt loop against the surfaces of which the web comes into direct contact. The present invention utilizes a technique which is directly contrary to the customary conventional techniques utilized in conventional multi-cylinder sections of the type disclosed disclosed in U.S. Pat. No. 3,503,139.

Conventional multi-cylinder drying sections have several drawbacks. For example, the speed of the surfaces of the drying cylinders in respective lines differ due to the different temperatures which the cylinders of the respective lines are raised and consequent differences in thermal expansion thereof. Another drawback is that the web to be dried tends to detach from the surface of the drying wire when the drying wire rather than the web comes into direct contact with the cylinder. This tendency is intensified by the positive pressures induced in the inlet nip between the drying wire and the cylinder surfaces. Detachment of the web from the drying wire can cause the web to break or form so-called bags or wrinkles in the web. Another drawback of conventional multi-cylinder dryers is that the drying wires tend to wear rather rapidly, especially in the case where the drying wires are made of plastic. This drawback is at least partly attributable to the fact that the drying wire is pressed into direct contact with the hot cylinder surface of the cylinders of one of the lines as well as to the fact that the wire is subject to a variable tension depending upon whether it is traveling in the upward or downward portions of its run.

A starting point of the present invention is an arrangement disclosed in Finnish Patent Application No. 81 2089 of Markku Lampinen of July 2, 1981, assigned to the assignee of the instant application. A multi-cylinder drying section of a paper machine is disclosed in which open drying wires are used to press the web against the cylinder surfaces and/or to support the web on the run between the cylinders. Drying wires are used which are penetrable by air whose permeability is greater than 500 $m^3/m^2/h$ when the difference in pressure over the wire is 100 Pa. The object of this construction is to cause the water vapor to condense in the wire despite the openness of the wire when the temperature of the wire is sufficiently low. In this manner, a sort of air-conditioning in the drying section of the paper machine is accomplished so that the temperature of the drying wire, such as a wire of a single-fabric draw, is as low as possible.

The apparatus disclosed in said Finnish Application No. 81 2089 is characterized by a wire pocket formed by the drying wire to be cooled, guided by guide rolls, the pocket being brought under a negative pressure to provide an airflow through the drying wire forming the walls of the pocket to cool the drying wire. Moreover, boxes or the like provided with airflow apertures are situated on both sides of the drying wire to produce an airflow through the meshes of the drying wire.

However, it has been found that in practice it is not possible to cool the drying wire utilizing the arrangement disclosed in Finnish Application No. 81 2089 to a sufficient extent so that the desired effects can be obtained to a sufficiently high level. Thus, it appears that the drying wire tends to become warm as a result of the fact that in a single-wire draw, the drying wire is in direct contact with the heated surface of the drying cylinder on one of the cylinder lines, usually the lower cylinder line, where the paper web remains on the outer surface of the drying wire, i.e., where the drying wire itself is in direct contact with the heated surface of the drying cylinder.

SUMMARY OF THE INVENTION

It is an object of the present invention to provide new and improved multi-cylinder drying sections and methods in paper machines by means of which the principles suggested in said Finnish Application No. 81 2089 are accomplished more efficiently.

Another object of the present invention is to provide new and improved multi-cylinder drying sections in paper machines which can be made considerably shorter than conventional multi-cylinder drying sections thereby providing reduced space requirements.

Still another object of the present invention is to provide new and improved multi-cylinder drying sections and methods in paper machines wherein the service life of the drying wire is increased.

Yet another object of the present invention is to accomplish the same objectives set forth above in twin-wire draw arrangements as well as in single-wire draw arrangements of the type described above. In this connection, single-wire draws are generally applied in the initial part of the drying section, i.e., in the part which immediately follows the press section of the paper machine, whereas twin-wire draws are applied in one or more cylinder groups at the end of the drying section, i.e., within the area in which the web has reached a sufficiently high degree of dryness and strength that it can endure a free and unsupported draw between the lines of drying cylinders without significant risk of breaks.

Still another object of the present invention is to provide new and improved multi-cylinder drying sections and methods in paper machines by means of which energy consumption is reduced.

Briefly, in accordance with the present invention, these and other objects are attained by providing in a first embodiment of the invention a method wherein the drying fabric is cooled as it runs between the cylinders on which the web is in direct contact with the heated surface of the drying cylinder, the cooling being carried out by pressing the drying fabric into direct contact with a cooling roll or cylinder surface whose contact area is sufficiently large to effect the necessary cooling. The drying section is characterized in that the cylinders or rolls in the line in which the drying fabric comes into direct contact with the cylinder surface with the web remaining outside, rather than being heated drying cylinders, comprise combined guide and contact-cooling rolls of relatively large diameter and which do not include any heating devices as such.

In a second embodiment of the invention which can be applied to the final end of the drying section, the drying wire is cooled in the spaces between the drying cylinders by providing guide rolls with mantles which are cooled and passing the drying wire, and/or felt, into direct contact with the cooled mantles of the guide rolls. The roll mantle cooling devices can be provided at one end of the guide roll by means of which a cooling medium is introduced into the roll mantle, the cooling medium being passed out from the interior of the roll mantle at the other end of the guide roll.

In connection with the application of the invention to a single-fabric draw arrangement, the temperature of the drying fabric can be lowered by about 20° to 30° C. which results in the various advantages described above and which will become clearer below.

DESCRIPTION OF THE DRAWINGS

A more complete appreciation of the present invention and many of the attendant advantages thereof will be readily understood by reference to the following detailed description when considered in connection with the accompanying drying s in which.

DESCRIPTION OF THE PREFERRED EMBODIMENTS

Figure 1:
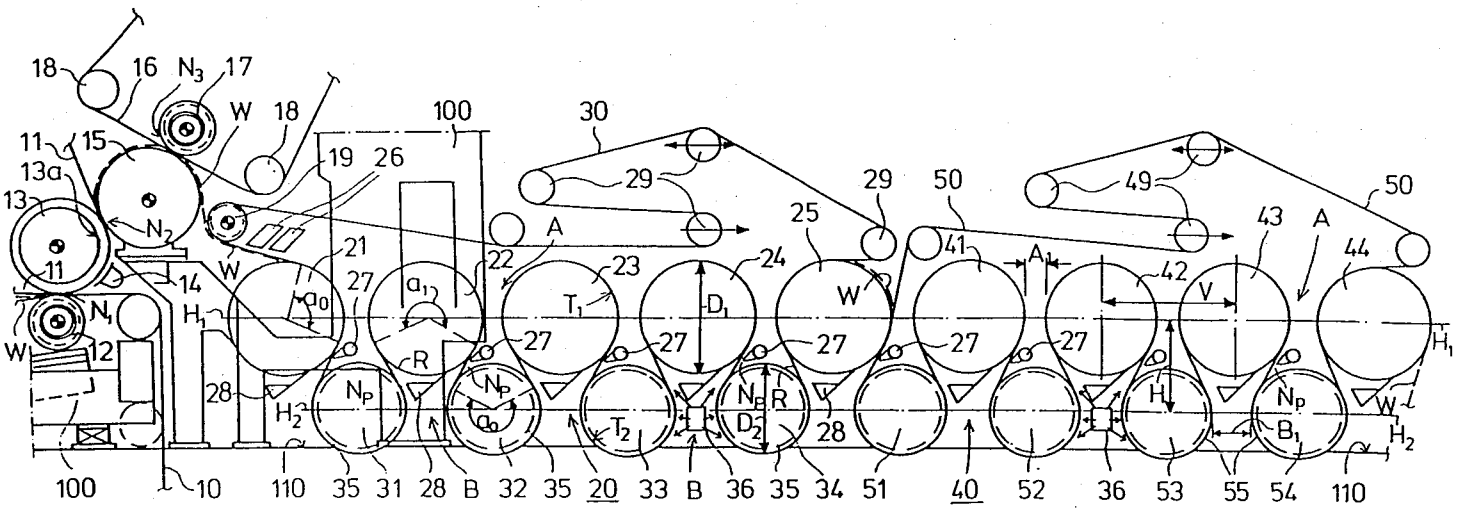
FIG. 1 is a schematic side elevation view of a multi-cylinder drying section in accordance with a first embodiment of the invention and a preceding closed press section.

Referring now to the drawings, and, in particular, to the embodiment illustrated in FIG. 1, a multi-cylinder drying section of a paper machine in accordance with the invention is illustrated. The drying section is preceded by a closed press section into which a paper web W is introduced on a pick-up fabric 11. The first press nip $N_1$ is formed between an upper press-suction roll 13 having suction zone 13*a* and a hollow-faced roll 12. The first nip $N_1$ is a two-felt nip and its lower felt is a press felt 10. The web W follows along with the upper felt 11 over the suction sector 13*a* of roll 13 into the second press nip $N_2$. A steam box 14 is situated in opposed relationship to the suction zone 13*a* as is conventional. The second press nip $N_2$ is formed between the press-suction roll 13 and the smooth faced rock roll 15. A third pres nip $N_3$ is formed by a press roll 17 and rock roll 15. A press fabric 16 passes through the press nip $N_3$ guided by guide rolls 18.

The web W is detached from the smooth face of the rock roll 15 by a detaching roll 19 so that the web W has a short straight free run between the press roll 15 and the detaching roll 19. The drying wire 30 of a first drying group, designated 20, is passed over the detaching roll 19. The drying wire 30, is, for example, a relatively open plastic wire whose permeability is on the order of about 500 to 1,500 $m^3/m^2/h$.

The web W is guided onto the first drying cylinder 21 or corresponding lead-in or baby cylinder on the lower surface of the drying wire 30. Attachment of the web W on the outer surface of the drying wire 30 between the detaching roll 19 and the first cylinder 21 is insured by means of blow boxes 26 which generate a negative pressure in the region between them and the web-carrying drying wire. In connection with the construction and operation of the blow boxe and the details of the draw of the web W from the press section to the drying section, reference is made to allowed U.S. application Ser. No. 595,969 to Eskelinen et al., assigned to the same assignee as the instant application.

The frame construction of the press and drying sections are illustrated schematically in FIG. 1 and designated 100. The floor level of the paper machine hall is designated 110.

The drying section in FIG. 1 includes two initial successive drying or wire groups 20 and 40 in which a single-wire draw is applied. The drying groups 20, 40 include an upper line of drying cylinders 21, 22, 23, 24, 25; 41, 42, 43, 44 whose axes lie in substantially the same horizontal plane $H_1$, and a lower line of cylinders 31, 32, 33, 34; 51, 52, 53, 54 whose axes lie in substantially the same horizontal plane $H_2$. As is conventional in a single-wire draw arranement, the drying cylinders in one of the lines remain outside the wire loop, while the cylinders in the other line remain within the wire loop so that the web is in direct contact with the heated surface of the drying cylinders situated outside of the wire loop while the drying wire is in direct contact with the surface of the rolls or cylinders which are situated within the wire loop with the web being spaced from the surfaces of the rolls or cylinders.

After the second one of the initial drying groups, i.e., drying group 40, two or three successive drying groups are generally provided having a twin-wire draw.

The upper cylinders 21, 22, 23, 24, 25 in the first group 20 are conventional steam-heated drying cylinders. The web-carrying drying wire 30 covers the first drying cylinder 21 over a cover angle $a_0$ in the range of about 90°–180°. The corresponding covering angle of the other cylinders, i.e., the sectors within which the web W to be dried is pressed by the drying wire 30 into direct contact with the cylinder surface, is designated $a_1$ and is about 250°. It is generally desirable to arrange the drying group so that the sector $a_1$ is as large as possible so that the efficiency of heat transfer from the surfaces of cylinders 21–25 and 41–44 to the web W is maximized.

According to the first embodiment of the invention, the cylinders in one of the lines in the multi-cylinder dryer with which the drying wire comes into direct contact and which in conventional prior art arrangements were constituted by heated drying cylinders are replaced by contact-cooling rolls. In the illustrated embodiment the drying wire comes into direct contact with cylinders which in conventional prior art arrangements were constituted by heated drying cylinders but which comprise contact-cooling rolls in accordance with the invention. In the embodiment illustrated in FIG. 1, the drying cylinders of the lower line, are replaced by contact-cooling rolls 31, 32, 33, 34 over which the wire 30 and the web W run so that the wire 30 to be cooled is in direct contact with the surface of the cooling rolls 31–34 whereas the web W remains spaced from the roll surfaces by the drying wire 30. The rolls 31–34 also function as guide rolls in the first drying group. Thus, in accordance with the invention, the rolls 31–34 are not heated by steam or any other mechanism. Rather, these rolls operate as contact-cooling members for cooling the drying wire 30. In fact, the rolls 31–34 may be provided with cooling apparatus, such, for example, as apparatus for passing a cooling medium into the rolls 31–34 or means for blowing air against the regions of the surfaces of the rolls 31–34 which are not covered by the web-carrying drying wire 30.

The covering angle $a_2$ of the web-carrying drying wire 30 on the rolls 31–34 is substantially equal to the covering angle $a_1$ on the drying cylinders 21–24. The contact-cooling rolls 31–34 are preferably provided with open surfaces 35, such as by machining spiral grooves therein.

Air-blowing devices 27 are arranged in the spaces A between adjacent upper drying cylinders 21–25 and reference is made to U.S. application Ser. No. 328,793, now U.S. Pat. No. 4,516,330, with respect to the detailed construction and operation of such devices. The air-blowing devices 27 function to eject air from the inlet nips $N_p$ formed between the drying wire 30 on the outer surface of which the web W is carried and the lower contact-cooling cylinders 31–34. A positive pressure would otherwise tend to form in such nips which would tend to detach the web W from the drying wire 30. Operation of the air-blowing devices 27 produces a negative pressure in the nips $N_p$ which is also effective in the grooves 35 formed in the surfaces of contact-cooling rolls 31–34 in order to insure that the web W is not detached by centrifugal forces from the outer surfaces of the drying wire 30 within the sectors $a_2$ of the rolls 31–34. The rolls 31–34 must have a sufficiently large diameter $D_2$ in lieu of such centrifugal forces.

Doctors 28 are situated between adjacent pairs of cooling rolls 31–34 and act on the lower free sectors of the heated drying cylinders 21–25. So-called underblow devices 36 are provided in one or more of the spaces B between the cooling rolls 31–34 in order to provide adequate air conditioning for the drying section.

The construction of the second drying group 40 which is provided with a drying wire 50 by means of which a single-fabric draw is provided from the drying cylinder 25 through the group 40 essentially corresponds to that of the first drying group 20. The upper line in the drying group 40 includes steam-heated drying cylinders 41, 42, 43, 44 and a lower line of contact-cooling and guide rolls 51, 52, 53, 54 having open, spiral grooved surfaces 55. The contact-cooling rolls 51–54 may be provided with cooling means as described above.

A group of drying cylinders (not shown) generally follows the last cylinder 44 of the group 40. A twin-fabric draw is applied in this following group of drying cylinders in which the cylinders in both the upper as well as in the lower line are steam heated with the web having an open draw between the line of cylinders. Thus, by the time the web W has reached the twin-fabric subsequent drying group, it has already reached such a high degree of dryness and strength in the initial drying groups 20 and 40 that there is no substantial risk of web breakage even with the open draws of the web.

In the drying section illustrated in FIG. 1, the diameter of the drying cylinders of the upper line is designated $D_1$, the diameter of the lower cooling rolls is designated $D_2$, the covering angle for the upper cylinders is designated $a_1$, the covering angle for the lower cylinders or rolls is designated $a_2$, the distance between adjacent upper drying cylinders is designated $A_1$, the distance between adjacent cooling rolls is designated $B_1$ and the difference in height between the planes $H_1$ and $H_2$ is designated H. As an example of typical dimensions, $D_1=1830$ mm, $D_2=1500$ mm, $a_1=248°$, $a_2=248°$, $A_1=270$ mm, $B_1=600$ mm, and $H=1420$ mm.

As noted above, in order to prevent detachment of the web W from the drying wires and to prevent bag formations in the web W, blow devices 26 and 27 and grooves 35, 55 in the surfaces of rolls 31–34 and 51–54 are utilized. The reliability of the run of the web W through the drying section can be further improved by providing the diameters $D_2$ of rolls 31–34 and 51–54 to be smaller than the diameters $D_1$ of the drying cylinders 21–25 and 41–44 as well as by shortening the construction of the drying section by reducing the dimensions $A_1$, $B_1$ and H. This of course has the effect of significantly reducing the length of the drying section and the overall length of the paper machine.

The running quality of the machine can be improved even further by providing one or more of the cylinders in either or both of the upper or lower lines with its own drive, i.e., a single drive, so that the speed differentials within the groups 20, 40 can be reduced. It has been conventional to provide both the upper and lower cylinders in a groups of drying cylinders with a common interconnected mechanical drive and it is well known that variations in the diameters of the cylinders can cause detrimental speed differences.

Since the rolls 31–34 and 51–54 in the drying section, in accordance with the invention do not heat the drying air, the air-conditioning of the drying section must be intensified. This is advantageously accomplished by means of the blow devices 26, 27 discussed above as well as by under-blow devices 36. The drying cylinders 21–25 and 41–45 may be constructed with even larger diameters than described above if necessary.

A drying section in accordance with the invention is particularly well suited for use in a newsprint machine or in other machines which produce relatively low-weight paper qualities.

The lower cooling rolls 31–34 and 51–55 may be provided with plastic coatings or the like, such, for example, as Teflon coatings to prevent corrosion and condensation. When steel rolls are used, the surface temperatures of the rolls 31–34 and 51–54 are preferably within the range of between about 50° to 80° C. and when coated rolls are used, surface temperatures below 58° C. can be used.

In accordance with the first embodiment of the method and apparatus of the invention, the temperatures or one or both of drying wires 30 and 40 can be substantially reduced relative to the temperatures of drying wires in conventional drying sections. Experiments have shown that the temperature of the drying wires can be reduced by an amount in the range of between about 20° to 30° C. The reduction of the temperature of the drying wires result in substantial increases in the drying capacity of the drying section and a significantly reduced specific consumption of energy.

TEST EXAMPLE

A series of tests have been carried out in order to determine the effect of closing the supply of heating steam to the lower cylinders in the single-draw group in a modern high-speed wide paper machine on the production running quality, and energy economy of the machine.

The following parameters were measured in a normal running situation (Test 1) and in a situation where the lower cylinders of the single-draw were closed (Test 2): surface temperatures of the cylinders, surface temperatures of the web, surface temperatures of the wire, and quantity of condensate per steam group as well as dry-solid percentages of the web per operating group. Production was maintained constant during the tests at a value of 25.7 t/h of 48.8 g/m$^2$ paper containing 80 percent of refiner groundwood and 20 percent of chemical pulp.

Figure 2:
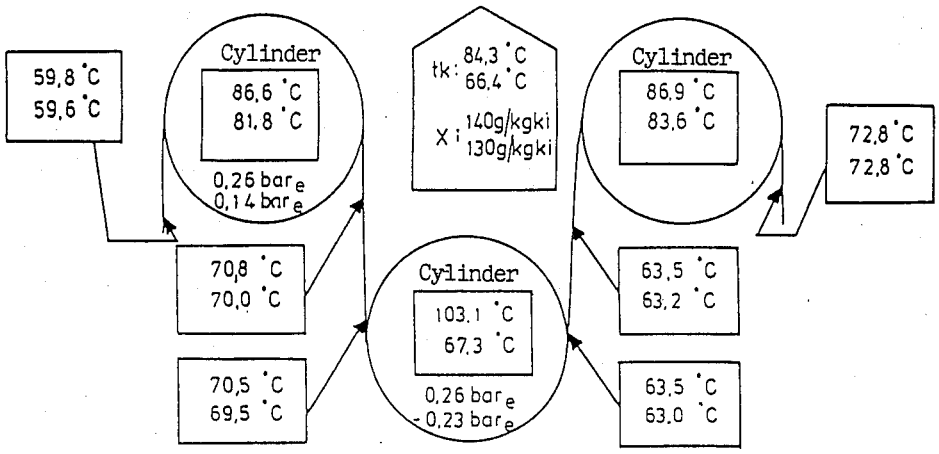
FIG. 2 is a diagramatic illustration of an initial drying group of a multi-cylinder drying section showing a comparison of the temperatures of the drying cylinders and web using a conventional arrangement and a test arrangement in accordance with the embodiment of FIG. 1.
Figure 3:
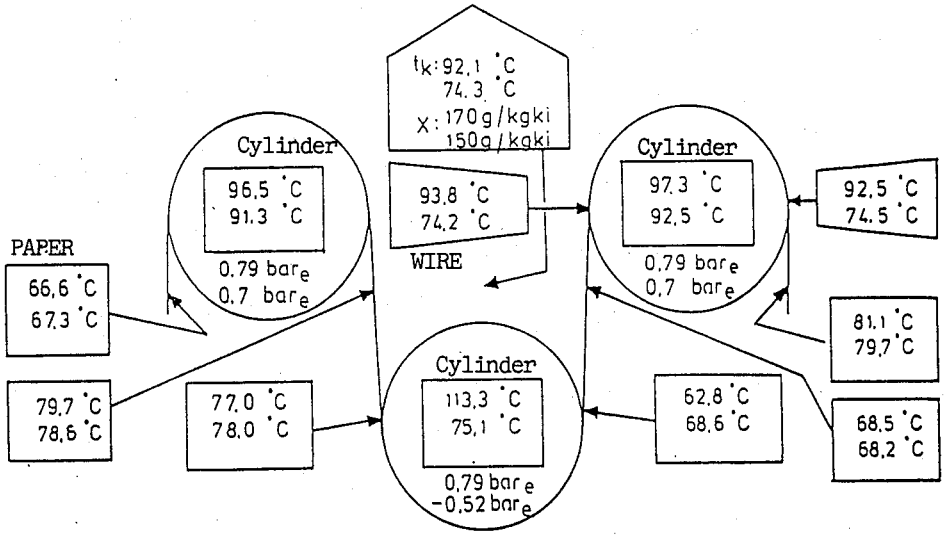
FIG. 3 is a diagramatic illustration similar to FIG. 2 of a second drying group of a multi-cylinder drying section.

The temperature of the cylinder surfaces and of the wire and web are shown in FIGS. 2 and 3. In connection with each figure, the upper temperature values is that measured during the normal running situation (Test 1) while the lower temperature values were measured when the steam supply to the lower cylinders was closed (Test 2).

In a normal running situation in the region of single-wire draw, the surface temperatures of the upper cylinders were in the range of between about 85° to 98° C. and the surface temperaturs of the lower cylinders were in the range of between about 102° to 114° C. When the supply of steam to the lower cylinders was closed, the surface temperatures of the lower cylinders was reduced to about 67° to 76° C., a difference of 35° to 38° C. By closing the supply of steam to the lower cylinders, the temperature of the drying wire was reduced about 20° in the second drying group.

During the tests, the samples of the web were taken after the first, second, and third operating groups as well as from the Pope reel-up. The values of the specific evaporations calculated from the dry-solid measurements of these samples are set forth in Table 1.

TABLE 1

| Steam group | Specific evaporation by steam group: Specific evapor. $kg/m^2h$ TEST 1 | Specific evapor. $kgH_2O/m^2h$ TEST 2 | Remarks |
|---|---|---|---|
| | | | press dry solids content |
| 1st steam group lower & upper | 9.6 | 11.3 | 43.4% (TEST 1.) |
| 2nd steam group lower & upper | | | |
| 3rd steam group lower & upper | 23.3 | | 42.8% (TEST 2.) |
| 4th steam group lower & upper | 9.4 | 16.1 | |

From Table 1. it is seen that the specific evaporation calculated from the dry-solid samples increased about 17% in the single-wire draw.

The consumption of total energy of the machine was slightly lower when the steam supplied to the lower cylinders was closed as compared to the normal running situation as seen from the following Table:

TABLE 2

| Steam and condensate flows | Test 1 | Test 2 |
|---|---|---|
| Steam to machine kg/s | 10.86 | 9.93 |
| Condensate from machine kg/s | 10.1 | 9.0 |
| Flow-through steam to surface condenser, calculated kg/s | 0.48 | 0.12 |
| Steam to pocket blow radiators (calculated) kg/s | 0.5 | 1.1 |
| Total to machine | 11.4 | 11.0 |

The differences in steam consumption results from the reduction in the mass flow of the flow-through and expansion steam (five cylinders being closed in the Test 2 run).

The invention also improves the efficiency of energy consumption of the drying section. The energy efficiency may be measured by the ratio of the quantity of steam supplied to the machine to the quantity of water evaporated, designated $\dot{m}_h/\dot{m}(H_2O)$. The following values were obtained in the tests described above:

$$\dot{m}_h/\dot{m}(H_2O)=1.34/1.27 \text{ (Test 1/Test 2)},$$

which is an improvement of about 5%. Energy consumption can be even further reduced by increasing the efficiency of the air-conditioning of the single-wire draw to avoid an increase in the temperature of the outlet air from the hood.

A second embodiment of the invention will now be described with reference to FIGS. 4 and 5.

Figure 4:
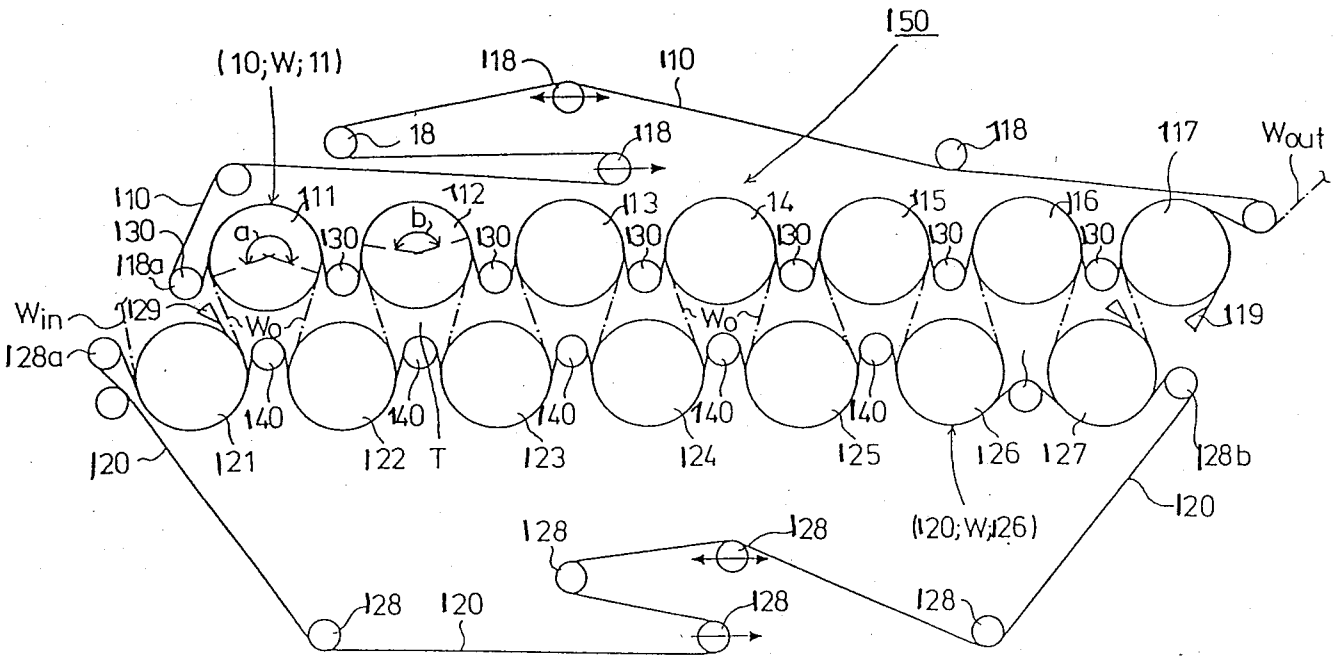
FIG. 4 is a schematic side elevation view of a cylinder group of a multi-cylinder drying section in accordance with a second embodiment of the invention.

The cylinder group shown in FIG. 4 may, for example, comprise the last cylinder group in the drying section into which the web $W_{in}$ is introduced from a preceding cylinder group or groups in which for example, a single-fabric draw is used. The preceding cylinder groups may also advantageously utilize the embodiment of the invention described above. After passing through the cylinder group illustrated in FIG. 4, the web $W_{out}$ is passed to the post-treatment devices of the paper machine, such, for example, as to the machine stack.

The cylinder group 150 comprises two horizontal lines of steam-heated drying cylinders, the upper line including drying cylinders 111, 112, 113, 114, 115, 116 and 117 and the lower line including drying cylinders 121, 122, 123, 124, 125, 126, and 127. A twin-fabric draw is applied in the cylinder group 150 by means of an upper drying wire 110 and a lower drying wire 120. Corresponding felts may be used rather than wires 110 and 120.

Referring to FIG. 4, the upper wire 110 is guided by guide rolls 118 and the lower wire 120 is guided by guide rolls 128. The first and last guide rolls of the upper wire 110 are designated **118*a* and 118*b* while the first and last guide rolls of the lower wire 120 are designated 128*a* and 128*b*. The drying wires 110 and 120 press the web W against the surfaces of the drying cylinders 111–117 and 121–127 thereby enhancing the direct contact between the web and the hot cylinder surfaces to promote drying efficiency. The contact sector between the web W and the drying cylinder is designated a and generally has a magnitude in the range of between about 200° to 240°. The corresponding cover angle b of the wires 110 and 120** on the cylinders is generally in the range of between about 140° to 170°. The web passes between the drying cylinders of the two cylinder lines in free unsupported draws $W_0$.

Rolls 130 are provided in the spaces between adjacent upper cylinders 111–117 which, in accordance with the invention, not only serve to guide the upper wire 110, but, additionally, act as cooling members for cooling the upper wire 110. Similarly rolls 140 are arranged in the spaces between the lower cylinders 121–127 which act to both guide as well as cool the lower wire 120.

Pockets T are defined between the rolls 130 and 140, the free draws $W_0$ of the web W and the free surfaces of the drying cylinders 111–117 and 121–127. These pockets are ventilated from their transverse ends and/or through the wires 110 and 120. If required, the guide rolls **118, 118*a* and 118*b* of upper wire loop 110 and/or the guide rolls 128, 128*a* and 128*b* of the lower wire 120** may be adapted to function as cooling elements for the respective wires.

It is understood that in accordance with the invention, only one or both of the drying wires 110, 120 may be cooled between the drying cylinders by means of guide rolls 130, 140. In the case where only one wire is cooled, it is preferred that the upper wire 110 be cooled. The cooling of the wires 110 and/or 120 is thus accomplished by contact cooling between the cooling rolls 130 and/or 140 and their respective wires which is most efficient.

By cooling the upper wire 110 and/or the lower wire 120 by means of the guide and cooling rolls 130, 140, sufficient cooling power and cooling surfaces may be applied to the runs of the wires 110 , 120 so that the wires do not have time to be excessively heated by the cylinders 111–117 and/or 121–127, since the cooling rolls 130, 140 are placed in the spaces between adjacent drying cylinders, preferably in all of such spaces in the upper and/or lower lines and are closely spaced. The drying cylinders may be arranged so that they are driven by means of the upper wire 110 and/or the lower wire 120. Conventional electronic controls systems can be utilized in connection with such drives.

Figure 5:
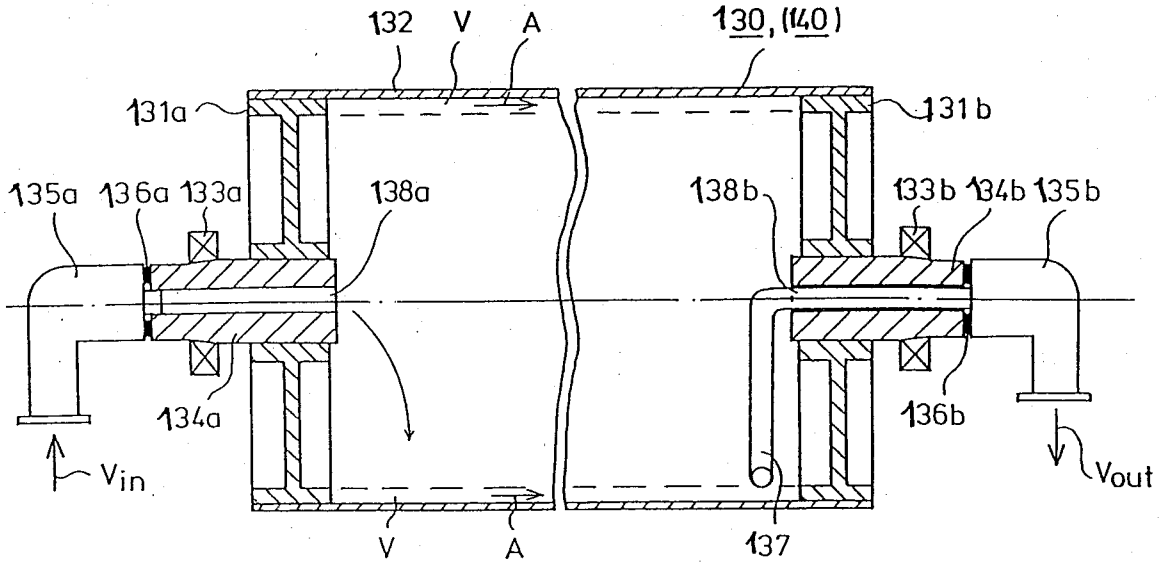
FIG. 5 is an axial sectional view of a combined cooling and guide roll suitable for use in the arrangement illustrated in FIG. 4.

Referring to FIG. 5, one embodiment of a guide and cooling roll 130 or 140 for use in the drying section shown in FIG. 4 is illustrated. The roll 130 (140) comprises a cylindrical mantle 132 and end caps or hubs **131*a* and 131*b* on which the mantle 132 is fitted. Mantle 132 preferably has a smooth outer face free of grooves. The ends 131*a* and 131*b* are mounted on shafts 134*a*, 134*b* which rotate on bearings 133*a* and 133*b***. The shafts 134*a*, 134*b* are provided with central openings 138*a*, 138*b* for fluid connectors 135*a*, 135*b*. Seals 136*a*, 136*b* are provided between the shafts 134*a* and 134*b* and the connectors 135*a*, 135*b*. Cooling medium, such as water, is passed through the connector 135*a*, designated $V_{in}$, passing through the opening 138*a* in the shaft 134*a* into the interior of the roll, where it contacts the inner surface of the mantle 132 under the effect of centrifugal force produced by the rotation of the roll so that a cooling water layer V of appropriate thickness is formed on the inner surface of the mantle 132. A water outlet pipe, 137, is provided at the other end 131*b* of the roll through which cooling water which has become warm through contact with the mantle 132 is removed from within the roll by means of suction connector 135*b*, designated $V_{out}$. The arrows A illustrate the direction of flow of the cooling water layer V within the roll 130. By adjusting the temperature of the cooling water, it is possible to control the cooling efficiency of the combined guide and cooling rolls 130 (140) to be optimal in view of the drying of the web W.

It is possible to construct the cooling and guide rolls 130, 140 in a manner other than that shown in FIG. 5. It will be understood that cooling medium other than water may be utilized, such, for example, as ammonia, freon or the like.

Obviously, several modifications and variations of the present invention are possible in the light of the above teachings. It is therefore to be understood that within the scope of the claims appended hereto, the invention may be praticed otherwise than as specifically disclosed herein.

What is claimed is:

1. A method for drying a web in a multi-cylinder drying section of a paper machine, the drying section including at least one single-fabric draw drying cylinder group comprising two lines of cylinders which are spaced from each other and a drying fabric running between cylinders of the two lines, the web being supported by said drying fabric in the spaces between the cylinder lines and carried by said drying fabric into direct contact with a heated surface of a drying cylinder of one line, the fabric being in direct contact with surfaces of such cylinders of the other line with the web situated on an outer surface of said drying fabric, comprising the steps of:

cooling the drying fabric as it runs between said cylinders with the surfaces of which the web is in direct contact, and wherein said cooling step is carried out by bringing said drying fabric into direct contact with a surface of at least one contact-cooling guide cylinder.

2. The method of claim 1, wherein said cooling step is carried out to lower the temperature of said drying fabric by an amount in the range of between about 20°–30° as compared to the temperature of a drying fabric in a single-fabric draw drying cylinder group in which the cylinders of the two lines over which the drying fabric runs are heated.

3. The method of claim 1 wherein said contact-cooling guide cylinders attain a temperature without being heated or cooled by external heating or cooling means.

4. The method of claim 1 wherein said cooling step is carried out by cooling said contact-cooling guide cylinders.

5. The method of claim 4 wherein said contact-cooling cylinders have a hollow interior and are cooled by passing a cooling medium into the said interior.

6. The method of claim 4, wherein said contact-cooling guide cylinders are cooled by directing cooling fluid onto the surfaces thereof.

7. The method of claim 1 wherein said contact-cooling guide cylinders have grooved surfaces, and comprising the further step of providing a negative pressure in said grooves to prevent the detachment of the web from the outer surface of said drying fabric when the drying fabric is in direct contact with the surfaces of said contact-cooling guide cylinders under the effect of centrifugal forces.

8. The method of claim 1 wherein the web-carrying drying fabric is brought into direct contact with a sector of the surface of a contact-cooling guide cylinder as it travels between two heated drying cylinders, the sector having a magnitude within the range of between about 200° to 270° and wherein the diameter of said contact-cooling guide cylinders is in the range of between about 800 to 1830 mm.

9. The method of claim 8, wherein the sector has a magnitude of about 250° and the diameter of said contact-cooling guide cylinders is about 1500 mm.

10. The method of claim 1 including the further step of intensifying the air-conditioning of said drying cylinder group by providing a negative pressure at inlet nips of said drying cylinder group defined by said drying fabric and said contact-cooling guide cylinders.

11. The method of claim 10 wherein the contact-cooling guide cylinders have grooved surfaces and wherein the negative pressure is also provided in said grooves.

12. The method of claim 1 including the further step of intensifying the air-conditioning of the drying cylinder group by providing under-blow devices in spaces between said contact-cooling guide cylinders.

13. A multi-cylinder drying section in a paper machine including at least one single-fabric draw drying cylinder group through which a web to be dried passes, comprising:

a first line of drying cylinders having heated surfaces;

a second line of cylinders having surfaces;

a drying fabric passing through the drying cylinder group, said drying fabric carrying the web so that the web is supported by the drying fabric over its entire passage through said drying cylinder group, the drying fabric pressing the web into direct contact with the heated surfaces of said drying cylinders of said first line, the drying fabric being in direct contact with the surfaces of said cylinders of said second line with the web carried on the outside of said drying fabric; and wherein said cylinders of said second line are contact-cooling guide rolls having a large diameter and which are devoid of means for heating the same.

14. The combination of claim 13 wherein said contact cooling guide rolls have open grooved surfaces.

15. The combination of claim 13 wherein said heated drying cylinders have diameters in the range of between about 1500 to 2500 mm and said contact-cooling guide rolls have diameters of about 20% less than the diameters of said heated drying cylinders.

16. The combination of claim 15 wherein said heated drying cylinders have diameters of about 1830 mm.

17. The combination of claim 13 wherein said drying fabric is in direct contact with the surfaces of said contact-cooling guide cylinders over a first cover angle in the range of between about 200° to 270°.

18. The combination of claim 17 wherein the web is in direct contact with the surfaces of said heated drying cylinders over a second cover angle in the range of about 200° to 270°.

19. The combination of claim 18 wherein said first and second cover angles are about 250°.

20. The combination of claim 8 further including air-blow means arranged in inlet nips defined by said web-carrying drying fabric and respective ones of said contact-cooling guide cylinders for ejecting air from said inlet nips.

21. The combination of claim 20 wherein said contact-cooling guide rolls have open grooved surfaces and wherein said air-blow means also eject air from said grooves.

22. The combination of claim 13 wherein said drying cylinder group follows a press section including a press roll from which the web is detached, a detaching roll situated proximate to said press roll over which said drying fabric passes, the web being detached from said press roll and adhering to said drying fabric passing over said detaching roll, said drying fabric having a straight run between said detaching roll and the first cylinder of said drying cylinder group, and air-blow means situated within a loop of said drying fabric for generating a negative pressure that supports the web on said straight run of said drying fabric.

23. The combination of claim 13 wherein said contact-cooling cylinders have metal coatings.

24. The combination of claim 13 wherein said contact-cooling cylinders have plastic coatings.

25. The combination of claim 24 wherein said plastic coatings are formed of Teflon.

26. The combination of claim 13, wherein intermediate spaces are formed between adjacent contact-cooling guide rolls and further including under-blow devices positioned in at least one said intermediate spaces.

27. The combination of claim 13 wherein single-line drive means drive said cylinders in at least one of said first and second lines of cylinders to eliminate differences in speed between the cylinders of said first and second lines.

28. The combination of claim 27 wherein said single-line drive means drive at least one of said cylinders in a respective line.

29. A method of drying a web in a multi-cylinder drying section of a paper machine, the drying section including successive spaced drying cylinders having heated surfaces and an outer drying fabric guided by guide rolls in the spaces between said successive drying cylinders for passing the web into direct contact with the heated surfaces of said drying cylinders, said guide rolls having mantles, comprising the steps of:

cooling said drying fabric in the spaces between said successive drying cylinders and wherein said cooling step is carried out by cooling said mantles of said guide rolls and passing said drying fabric into direct contact with said cooled mantles.

30. The method of claim 29 wherein the drying section includes a first upper substantially horizontal line of drying cylinders and a second lower substantially horizontal line of drying cylinders, the web having free unsupported draws between the cylinders of said upper and lower lines, an upper drying fabric passing the web into direct contact with the heated surfaces of said drying cylinders of said upper line, and a lower drying fabric pressing the web into direct contact with the heated surfaces of said drying cylinders of said lower line, at least one of said upper and lower drying fabrics being guided by cooling guide rolls situated in spaces between said cylinders of said upper and lower lines.

31. The method of claim 30 wherein both of said upper and lower drying fabrics are cooled by cooling guide rolls situated in spaces between said cylinders of said upper and lower lines.

32. The method of claim 30 wherein only said upper drying fabric is cooled by cooling guide rolls situated in spaces between said cylinders of said upper line.

33. The method of claim 29 wherein said drying fabric comprises belt means for driving said heating drying cylinders.

34. A multi-cylinder drying section in a paper machine including at least one drying cylinder group through which a web to be dried passes, comprising:

a first upper line of dryng cylinders having heated surfaces;

a second lower line of drying cylinders having heated surfaces;

an upper drying fabric guided by upper guide rolls having mantles situated in spaces between said drying cylinders of said upper line, said upper drying fabric directly contacting said mantles of said upper guide rolls;

a lower drying fabric guided by lower guide rolls having mantles situated in spaces between said drying cylinders of said lower line, said lower drying fabric directly contacting said mantles of said lower guide rolls; and wherein at least one of said upper and lower guide rolls include means for cooling said mantles thereof to cool a respective one of said upper and lower drying fabrics.

35. The combination of claim 34 wherein said cooling means comprise means for introducing fluid cooling medium into the guide roll to contact the mantle thereof and means for discharging the cooling medium therefrom.

36. The combination of claim 35 wherein said cooling medium is water.

37. The combination of claim 35 wherein said means for introducing said fluid cooling medium into the guide roll comprises fluid inlet conduit means communicating with the interior of said guide roll at one end of said guide roll whereby the cooling medium forms a layer of cooling medium on the inner surface of said roll mantle, and wherein said means for discharging the cooling medium includes fluid outlet conduit means communicating with the interior of said guide roll at the other end of said guide roll and proximate to the roll mantle for discharging warmed cooling medium.

38. The combination of claim 34 wherein said drying group is the last group in said drying section.

39. A method of drying a web in a multi-cylinder drying section of a paper machine, the drying section including at least one drying cylinder group comprising a plurality of heated drying cylinders and a drying fabric for carrying a web to be dried into direct contact with the surfaces of said heated drying cylinders, comprising the steps of:

cooling the drying fabric as it runs between said heated drying cylinders with which the web is in direct contact and wherein said cooling step is carried out by bringing said drying fabric into direct contact with the surface of non-heated cooling cylinder.

40. The method of claim 39 wherein said drying section includes at least one initial single-fabric draw drying cylinder group comprising two lines of cylinders which are spaced from each other and a first drying fabric running between cylinders of the two lines, the web being supported by said drying fabric in the spaces between the cylinders lines, and at least once subsequent twin-fabric draw drying cylinder group comprising two lines of heated drying cylinders which are spaced from each other, an upper drying fabric pressing the web into direct contact with the drying cylinders of said upper line, and a lower drying fabric pressing the web into direct contact with the drying cylinders of said lower line, the web having free unsupported draws between cylinders of said upper and lower lines, and wherein said first drying fabric and at least one of said upper and lower drying fabrics are cooled by bringing them into direct contact with surfaces of non-heated cooling rolls.

41. The method of claim 40 further including the step of cooling said cooling rolls.

42. A drying section in a paper machine including at least one drying cylinder group comprising a plurality of heated drying cylinders and a drying fabric for carrying a web to be dried into direct contact with the surfaces of said heated drying cylinders and means for cooling said drying fabric as it runs between heated drying cylinders with which the web is in direct contact, said cooling means comprising cooling rolls with which the drying fabric is brought into direct contact.

43. The combination of claim 42 wherein said drying section includes at least one initial single-fabric draw drying cylinder group comprising two lines of cylinders which are spaced from each other and a first drying fabric running between cylinders of the two lines, the web being supported by such drying fabric in the spaces between the cylinder lines, and at least one subsequent twin-fabric draw drying cylinder group comprising two lines of heated drying cylinders which are spaced from each other, an upper drying fabric pressing the web into direct contact with the drying cylinders of said upper line, and a lower drying fabric pressing the web into direct contact with the drying cylindes of said lower line, the web having free, unsupported draws between the cylinders of said upper and lower lines and wherein said first drying fabric and at least one of said upper and lower drying fabrics are cooled by bringing them into direct contact with a surface of non-heated cooling rolls.

44. A combination of claim 42 further including means for cooling said cooling rolls.

* * * * *